US008277301B2

(12) United States Patent
Spangler

(10) Patent No.: US 8,277,301 B2
(45) Date of Patent: Oct. 2, 2012

(54) METHOD AND A SYSTEM FOR A MULTIDIMENSIONAL GAME

(75) Inventor: Benjamin Spangler, Raleigh, NC (US)

(73) Assignee: North Carolina Education Lottery, Raleigh, NC (US)

( * ) Notice: Subject to any disclaimer, the term of this patent is extended or adjusted under 35 U.S.C. 154(b) by 1215 days.

(21) Appl. No.: 12/042,096

(22) Filed: Mar. 4, 2008

(65) Prior Publication Data

US 2009/0227317 A1 Sep. 10, 2009

(51) Int. Cl.
*A63F 9/24* (2006.01)

(52) U.S. Cl. ..... 463/17; 463/19

(58) Field of Classification Search ..... 463/19, 463/17

See application file for complete search history.

(56) References Cited

U.S. PATENT DOCUMENTS

| | | | | |
|---|---|---|---|---|
| 5,232,221 | A | 8/1993 | Sludikoff et al. | |
| 5,257,784 | A | 11/1993 | Boylan et al. | |
| 5,927,714 | A | 7/1999 | Kaplan | |
| 5,979,894 | A | 11/1999 | Alexoff | |
| 6,322,445 | B1 * | 11/2001 | Miller | 463/13 |
| 6,514,144 | B2 | 2/2003 | Riendeau et al. | |
| 6,572,106 | B2 | 6/2003 | Alexoff | |
| 6,733,387 | B2 | 5/2004 | Walker et al. | |
| 6,758,757 | B2 | 7/2004 | Luciano, Jr. et al. | |
| 6,875,108 | B1 | 4/2005 | Hughs-Baird | |
| 6,923,721 | B2 | 8/2005 | Luciano et al. | |
| 6,955,353 | B2 | 10/2005 | Taylor et al. | |
| 7,213,811 | B2 | 5/2007 | Bozeman | |
| 2002/0155876 | A1 | 10/2002 | Taylor et al. | |
| 2006/0178194 | A1 | 8/2006 | Jubinville et al. | |
| 2006/0287055 | A1 | 12/2006 | Hamud | |
| 2007/0057461 | A1 | 3/2007 | Meyer et al. | |

OTHER PUBLICATIONS

Lottery Dynamics Corp., www.YourStateLottery.com, 2008, 2 pages.

"Instant-Online Games: Lucky DoughTM, Prize CatcherTM, & Diamond O'MineTM". 4 pages. GTECH Corporation. Providence, RI, Dated prior to Mar. 4, 2008.

* cited by examiner

*Primary Examiner* — Corbett B Coburn

(74) *Attorney, Agent, or Firm* — Coats & Bennett, P.L.L.C.

(57) ABSTRACT

A method, a system and a computer program for a feature game of a multidimensional grid to be used together with a base game. A player may play an initial base game and elect to play the feature game. The player may be provided with a ticket that becomes a winning ticket if some or all of the characters in the multidimensional grid adjoin so as to produce a winning line of horizontal, vertical or diagonal matching characters with a winning set of characters. More than one winning line is possible on each game ticket, producing multiple ways of winning on a single game ticket.

2 Claims, 6 Drawing Sheets

METHOD AND A SYSTEM FOR A MULTIDIMENSIONAL GAME

BACKGROUND OF THE INVENTION

1. Field of the Invention

The invention is directed generally to a method, a system and a computer program for a multidimensional game that may be added to a base game of chance or provided as a feature game.

2. Background of the Invention

In many games of chance, a player may arbitrarily select a predetermined number of numbers from a larger set of numbers and purchase a wagering ticket having the selected numbers. For example, a player may select six numbers and purchase a lottery ticket having the selected six numbers. The selected numbers are then matched to an equal number of randomly selected numbers and if a match occurs, the holder of the wagering ticket is awarded a prize.

While various games of chance exist that increase interest, there is a need to provide games of chance with simple and interesting variations to increase wagering opportunities.

Accordingly, there is a need for a method, a system and a computer program that allows for multiple wins on a single game of chance ticket.

SUMMARY OF THE INVENTION

The invention meets the foregoing need and provides a method, a system and a computer program for a feature game of a multidimensional grid to an existing game of chance or as a standalone feature game of chance that furthermore includes other advantages apparent from the discussion herein.

The invention may be implemented in a number of ways. According to one aspect of the invention, a player may purchase a game of chance ticket (a game ticket) for a feature game and/or a base game with an add-on feature game of a tic-tac-toe style grid. The player may win a game by matching one or more characters on the game ticket that are drawn for a particular game. The player may also win by matching, for example, a plurality of characters on the tic-tac-toe style grid as though one were playing, e.g., tic-tac-toe—across, down, and diagonally—on the grid.

According to an aspect of the invention, a method is provided for executing a game of chance comprising a multidimensional grid that includes a plurality of characters. The method comprises: generating a grid having a plurality of cells, each of the cells being populated by a character randomly selected from a set of characters; determining all possible winning combinations of the plurality of cells in the grid; determining a repetition frequency for each character in the grid; comparing the determined repetition frequency to a repetition frequency threshold; processing the grid on a basis of a result of the comparison of the determined repetition frequency to the repetition frequency threshold. The processing the grid on the basis of the determined repetition frequency may comprise one of rejecting the grid or storing the grid in a storage comprising a plurality of grids.

The method may further comprise comparing all of the possible winning combinations of the plurality of cells in the grid to each of the plurality of grids in the storage; determining a number of wins for the grid on a basis of the comparison; and processing the grid on a basis of the determined number of wins. The processing the grid on the basis of the determined number of wins may comprise comparing the number of wins to a predetermined win number; tagging and storing the grid on a basis of a result of the comparison of the number of wins to the predetermined win number; and retagging at least one stored grid on the basis of the result of the comparison. The grid may comprise at least two cells including identical characters.

The method may further comprise selecting a grid from the plurality of stored grids; and reproducing the selected grid on a game ticket as an add-on feature game or a feature game. The selected grid may be a winning grid selected following a certification of a draw and the game ticket may be one of a physical game ticket or a virtual game ticket. The selected grid may be a winning grid selected following a certification of a draw. The game ticket may be one of a physical game ticket or a virtual game ticket. The repetition frequency may be adjustable by a user. The predetermined win number may be adjustable by a user.

According to one aspect of the invention, a pick 3 lottery game of chance may comprise a grid generated according to the method. Moreover, the game of chance may comprise a base game and an add-on feature game or a feature game alone.

According to a further aspect of the invention, a computer readable medium is provided comprising a computer program for executing a game of chance comprising a multidimensional grid that includes a plurality of characters. The medium comprises: a grid generating code section that, when executed, causes generating a grid comprising a plurality of cells, each of the cells being populated by a character randomly selected from a set of characters; and a winning combination determining code section that, when executed, causes determining all possible winning combinations of the plurality of cells in the grid.

The medium may further comprise a repetition frequency determining code section that, when executed, causes determining a repetition frequency for each character in the grid; a repetition frequency comparing code section that, when executed, causes comparing the determined repetition frequency to a repetition frequency threshold; and a grid processing code section that, when executed, causes processing the grid on a basis of a result of the comparison of the determined repetition frequency to the repetition frequency threshold.

Further, the medium may also comprise a grid rejecting code section that, when executed, causes rejecting the grid; and a grid storing code section that, when executed, causes storing the grid in a storage comprising a plurality of grids.

Still further, the medium may comprise a winning grid comparing code section that, when executed, causes comparing all of the possible winning combinations of the plurality of cells in the grid to each of the plurality of grids in the storage; a win number determining code section that, when executed, causes determining a number of wins for the grid on a basis of the comparing; and a win number processing code section that, when executed, causes processing the grid on a basis of the determined number of wins.

The medium may also comprise a win number comparing code section that, when executed, causes comparing the number of wins to a predetermined win number; a tagging code section that, when executed, causes tagging the grid on a basis of a result of the comparison of the number of wins to the predetermined win number; a storing code section that, when executed, causes storing the grid on a basis of a result of the comparison of the number of wins to the predetermined win number; and a retagging code section that, when executed, causes retagging at least one stored grid on the basis of the result of the comparison.

The medium may further comprise a grid selecting code section that, when executed, causes selecting a grid from the plurality of stored grids; and a grid reproducing code section that, when executed, causes reproducing the selected grid on a game ticket as an add-on feature game or a feature game.

According to a further aspect of the invention, a system is provided for executing a game of chance comprising a multidimensional grid that includes a plurality of characters. The system comprises a grid generator configured to generate a grid comprising a plurality of cells, each of the cells being populated by a character randomly selected from a set of characters; a repetition frequency determiner configured to determine a repetition frequency for each character in the grid; a repetition frequency comparator configured to compare the determined repetition frequency to a repetition frequency threshold; a grid processor configured to process the grid on a basis of a result of the comparison of the determined repetition frequency to the repetition frequency threshold; a winning combination determiner configured to determine all possible winning combinations of the plurality of cells in the grid; a win combination comparator configured to compare all of the possible winning combinations of the plurality of cells in the grid to each of the plurality of grids in the storage; a win number determiner configured to determine a number of wins for the grid on a basis of a result of the win combination comparator; and a win number processor configured to process the grid on a basis of the determined number of wins. The win number processor may comprise a win number comparator configured to compare the number of wins to a predetermined win number; a tagger configured to tag the grid on a basis of a result of the win number comparator; a retagger configured to retag at least one stored grid on the basis of the result of the win number comparator.

The system may further comprise a grid selector configured to select a grid from the plurality of stored grids; and a game ticket reproducer configured to reproduce the selected grid on a game ticket.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
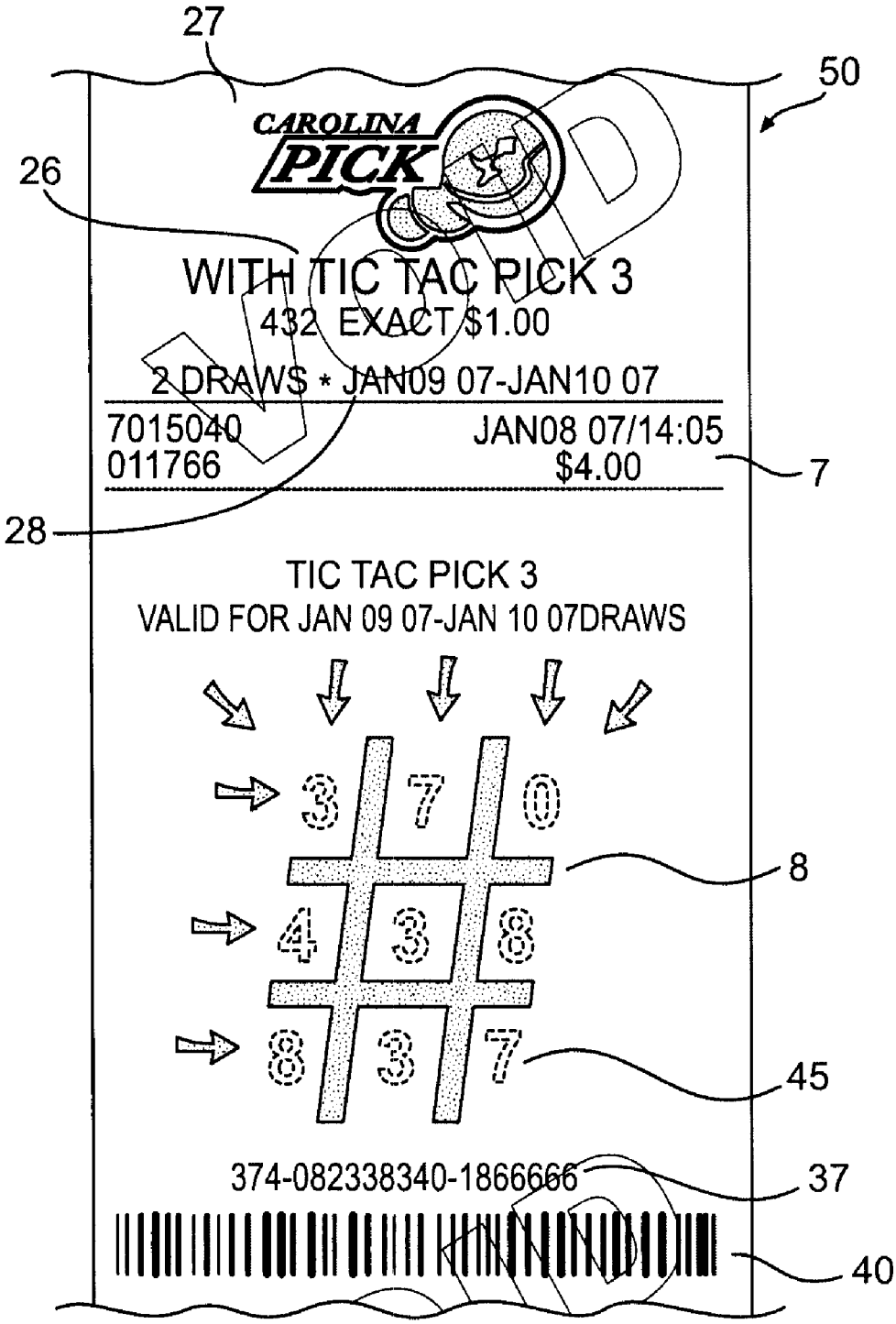
FIG. 1 shows an illustration of an exemplary game ticket according to an aspect of the invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

According to an aspect of the invention, a player may be provided with an option to play a feature game when the player elects to participate in a game of chance by, for example, purchasing a base game and an add-on feature game or purchasing a feature game alone. The base game may be any game of chance where a player is provided with a predetermined set of characters from which the player must select a smaller subset of characters. For example, the base game may be a lottery game having two, three, four, five, six, seven or more characters that may be selected by a player (or a computer device such as, for example, a lottery computer terminal) and subsequently matched to an equal number (or lesser number) of characters that are randomly selected or randomly drawn by a game of chance provider, such as, for example, a lottery administering entity using, e.g., a lottery number drawing machine.

The feature game may be a multidimensional game having a plurality of cells. The cells may be configured in rows and columns to form, for example, a multidimensional matrix or grid. Each of the cells may be populated with a character that was previously selected by a player from a larger set of characters. Further, the cells may be populated with characters that are selected by a computer device (such as, for example, a lottery computer terminal, a remote computer that is linked to a game of chance computer device through a network, or the like). In this regard, the characters may be selected or generated by the computer device using, for example, a random number generator. The characters may be selected individually to populate the cells of a grid for a particular feature game, or a completed grid of characters may be selected from a plurality of completed grids of characters that may be stored locally in the computer device or stored remotely in another computer device. Further, the characters (or the completed grids of characters) may be selected or generated by the computer device so that a predetermined number of winners may likely result from a particular game of chance drawing.

The characters that may be selected by a player or a computer device for the base game or the feature game include numeric characters such as, for example, the numbers 0 to 9. The player may select the characters by, for example, filling a playing card, entering data into a computer device, communicating the characters to a game of chance administering attendant using spoken and/or written communication, or the like. As the skilled artisan will readily appreciate, the characters may include alphanumeric characters selected from at least one of the world languages (such as, e.g., Arabic, Chinese, English, French, German, Japanese, Korean, Latin, and the like), pictorial characters (such as, e.g., images of animals, images of toys, images of fruits, images of food types, images of famous persons, images of landmarks, images of building structures, or the like), symbol characters (such as, e.g., squares, triangles, circles, or the like), or a combination of alphanumeric characters, pictorial characters and/or symbol characters, without departing from the scope or spirit of the invention.

The player may be provided with multiple opportunities to win a prize. For example, the player may be provided with an opportunity to win a prize if the characters in the base game purchased by the player match an equal or lesser number of subsequently selected or randomly drawn characters. The player may be provided with further opportunities to win a prize (or to win an additional prize) if the characters in the feature game match one or more subsequently selected or randomly drawn characters and the characters in the feature game are configured in one or more predetermined geometric configurations. Further, the winning characters for the feature game may be determined prior to providing the player with an option of playing the feature game.

FIG. 1 shows a preferred embodiment of the invention. According to the preferred embodiment of the invention, a player may participate in a game of chance, for example, by purchasing a Pick 3 lottery game. The player may be provided with an opportunity to play a feature game of a random tic-tac-toe style grid 8, which may be reproduced on a game ticket 50. The game ticket 50 may be a single game ticket, including both the base game and the feature game, or a plurality of game tickets, including only the base game or only the feature game. Further, the game ticket may be a physical ticket with characters reproduced on a base material (such as, e.g., paper, plastic, metal, wood, cloth, or the like) or a virtual ticket (such as, e.g., an electronic ticket) that may be associated with a record (or file) entry in a database and that may be reproduced as an image on a display device, such as, for example, a computer display, a telephone display, a personal data assistant (PDA) display, or the like.

The grid 8 may include characters, such as, for example, the numbers 0 through 9, in a plurality of cells 45 of the game ticket 50. The game ticket 50 may also include the player's original wager information 7, which may be reproduced in a predetermined area of the game ticket 50 along with the grid 8, which may be reproduced in another predetermined area of the game ticket 50.

The grid 8 may be generated at the start of a game to ensure that no grid 8 contains any character more than a predetermined number of times (such as, e.g., three times) and that there is an even distribution of winning grids 8 amongst a plurality of reproduced game tickets. Following a game drawing, the player may play the base game ticket 50 by matching the characters on the game ticket 50 to an equal number (or lesser number) of base game winner characters that have been randomly drawn or selected from a larger group of base game characters. Additionally, the player may play the feature game by matching the characters reproduced in the cells 45 of the grid 8 to a feature game winner grid having an equal number of cells.

Figure 2:
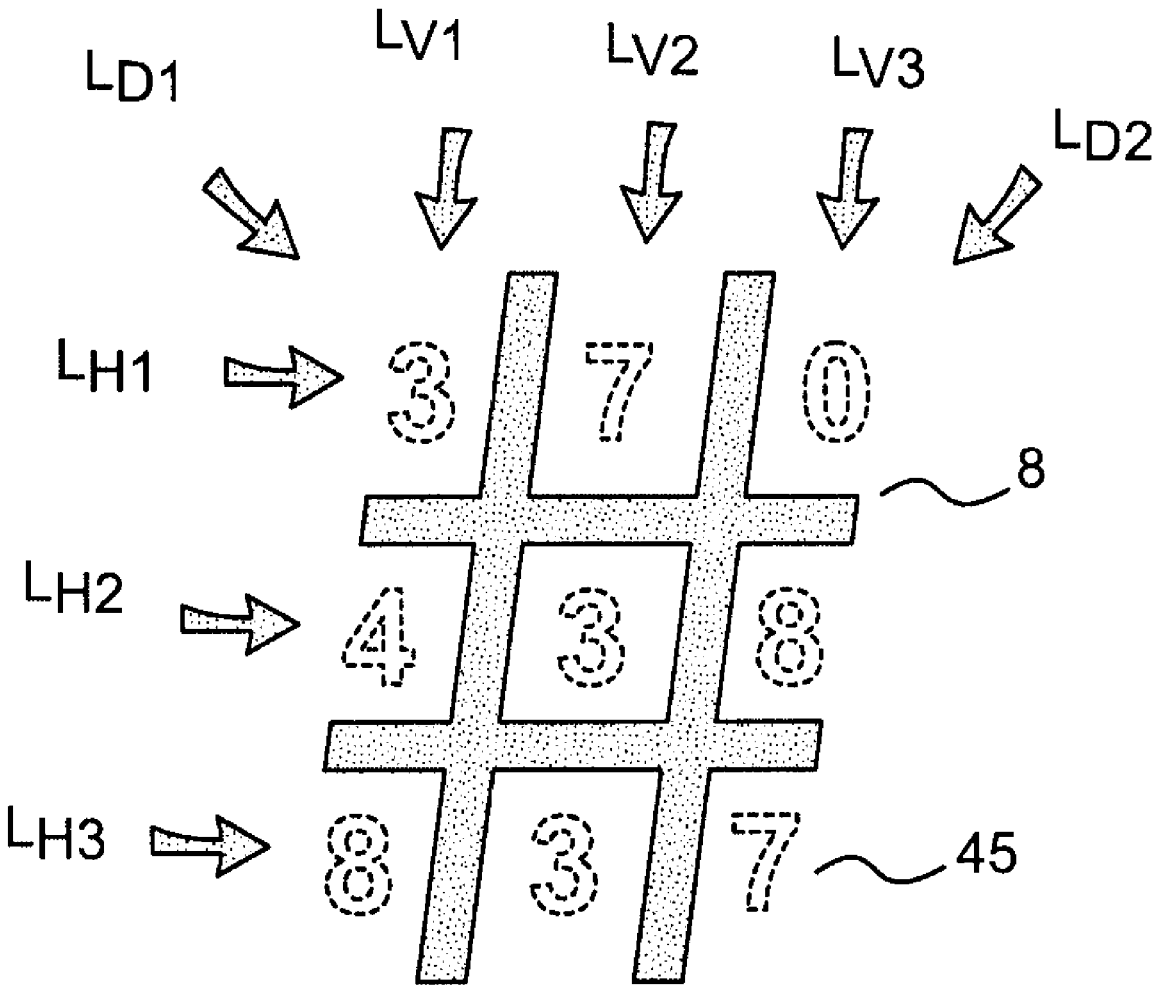
FIG. 2 shows an illustration of an exemplary feature game according to an aspect of the invention.

FIG. 2 shows an illustration of the exemplary grid 8. In FIG. 2, a prize may be awarded for a particular game ticket 50 based on one or more geometric configurations of the characters populating the cells 45 of the grid 8. For example, a prize may be awarded by matching three characters that are drawn for the Pick 3 game to the characters populating the cells 45 on the grid 8. Hence, a game ticket 50 can be a winning ticket if the grid 8 includes three consecutive cells arranged in at least one of a row $L_H$, a column $L_V$ and/or a diagonal line $L_D$ that comprise adjoining characters that match the winning characters. Specifically, the characters may be matched in order (or not in order) in any one of the columns $L_{V1}$, $L_{V2}$, $L_{V3}$, any one of the rows $L_{H1}$, $L_{H2}$, $L_{H3}$, or along one of the diagonals lines $L_{D1}$ or $L_{D2}$. The characters in the grid 8 may be compared to the winning characters to determine whether the game ticket 50 has one or more winning rows $L_H$, columns $L_V$, or diagonal lines $L_D$. Prizes, such as, for example, cash, may be awarded for each winning row $L_H$, column $L_V$, or diagonal line $L_D$. The prizes may be awarded on a basis of a number of winning rows $L_H$, columns $L_V$, or diagonal lines $L_D$ for a particular game ticket 50. For example, the value or the size of a prize to be awarded for a particular game ticket 50 may be determined on a basis of the number of winning rows, winning columns and/or winning diagonals on the particular game ticket 50. Hence, multiple wins may be awarded a higher prize and may be programmed into a grid generation process, discussed below with reference to FIG. 5.

Additionally, the value or the size of the prize to be awarded for a particular game ticket 50 may be determined on a basis of a match type. The match type may include, for example, an identification of a particular row in a plurality of rows in the grid 8; an identification of a particular column in a plurality of columns in the grid 8; or an identification of a particular diagonal in a plurality of diagonals in the grid 8. Hence, a prize to be awarded for a game ticket 50 having a particular matching column may have a different value or size from a prize to be awarded for a game ticket 50 having another matching column, row or diagonal.

Also provided on the game ticket 50 may be one or more of the following: a name of the game 26, a game owner/sponsor 27, a date (or dates) of the drawing event(s) 28, a game ticket identifier 37 and/or a machine readable game ticket identifier 40. As the skilled artisan will readily appreciate, other kinds of information may be reproduced or associated with a game ticket 50, depending on, e.g., a particular application of the invention, without departing from the scope or spirit of the invention. For instance, the game ticket 50 may include player identifying information (such as, e.g., an image of a player, a fingerprint of a player, or the like).

Figure 3:
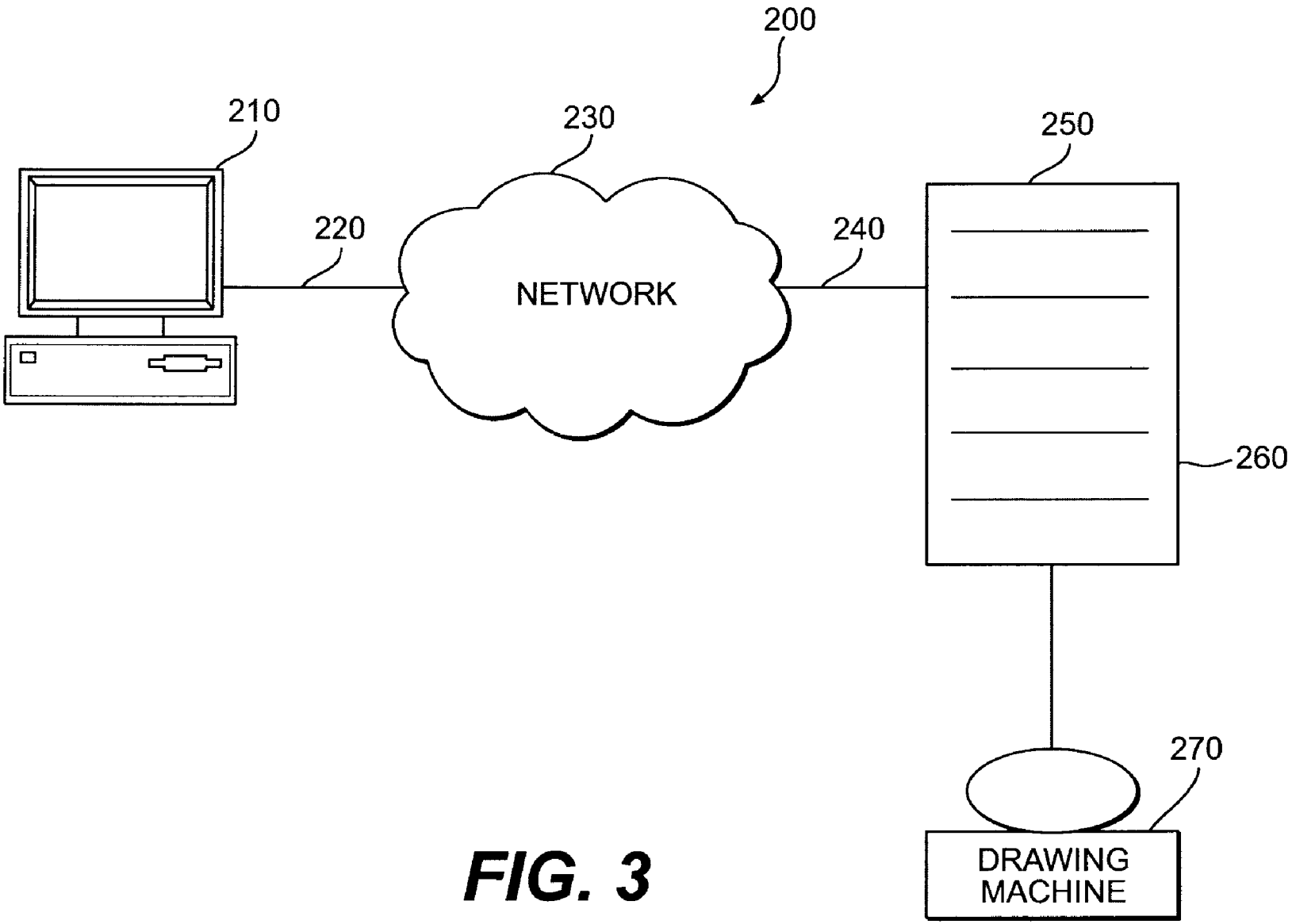
FIG. 3 shows an exemplary game feature system according to an aspect of the invention.

FIG. 3 illustrates an exemplary system 200 for carrying out a game of chance, including the base game and an add-on feature game or a feature game alone, according to an aspect of the invention.

Referring to FIG. 3, the system 200 includes a local terminal 210, a remote computer 250 and a drawing machine 270. The local terminal 210 may be coupled to the remote computer 250 via communication links 220, 240 and a network 230. The remote computer 250 may be coupled to the drawing machine 270 via a communication link 260.

The local terminal 210 and the remote computer 250 may each include, but are not limited to, for example, any one or more of a general purpose computer, a personal computer, a laptop computer, a notebook computer, a palm-top computer, a workstation, a server, a lottery game computer terminal device, a lottery game server, a database, or the like, depending on the particular application, without departing from the scope and/or spirit of the invention. Moreover, the local terminal 210 and the remote computer 250 may include software and/or hardware configured to carryout aspects of the invention.

The local terminal 210 may be strategically located at, for example, a vendor location, a personal site location (such as, e.g., a home, a place of business, or the like), a public site location (such as, e.g., a public facility), or the like, depending on a particular application of the invention, as the skilled artisan will readily appreciate.

Further, the remote computer 250 may be located at the same location as the local terminal 210 or at a different location, which is remote from the location of the local terminal 210, such as, for example, a central data warehouse facility, or the like.

The communication links 220, 240 and 260 may include at least one of, or a combination of a wired communication medium, a wireless communication medium, an optical communication medium, or the like, capable of bidirectionally transporting communication data, as is known by those skilled in the art.

The network 230 may include a local area network (LAN), a wide area network (WAN), a broadband network, the Internet, or the like, or any combination of a LAN, a WAN, a broadband network, the Internet, or the like.

The drawing machine 270 may be a machine that randomly selects one or more objects from a group of objects. Moreover, the drawing machine 270 may include a plurality of machines, each of which may randomly select one or more objects from a particular group of objects associated with the particular machine. Each of the objects may be provided with a character marker. For example, the objects may be balls labeled with numbers and the drawing machine 270 may be a lottery ball drawing machine that randomly selects lottery balls from a bin of lottery balls, as is known by those skilled in the art.

Figure 4:
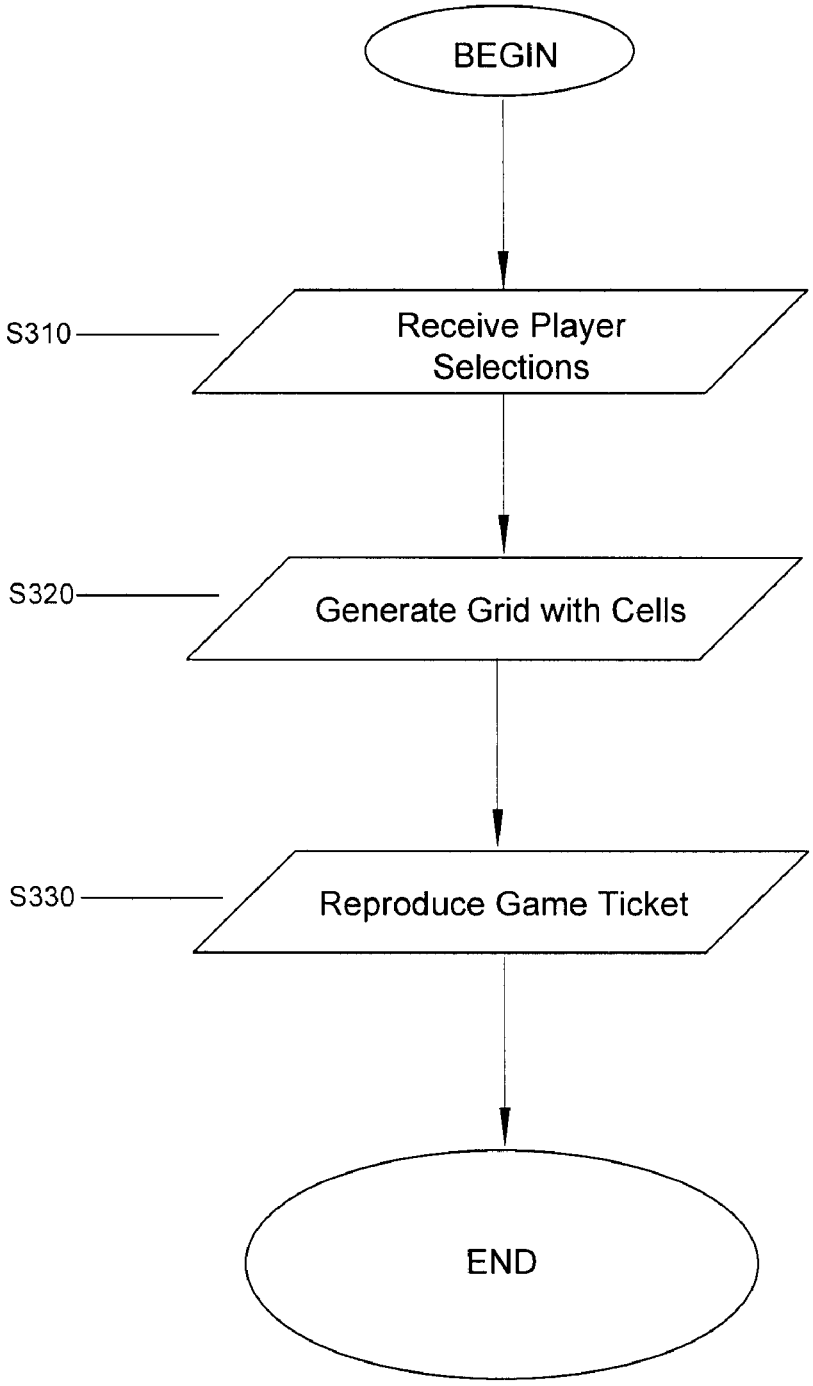
FIG. 4 shows an exemplary game ticket generation process according to an aspect of the invention.

FIG. 4 illustrates an exemplary game ticket generation process that may be performed to reproduce the feature game on the game ticket 50, shown in FIG. 1. The process may begin when a predetermined number of characters are received from a player (such as, e.g., three or more characters) or randomly generated by a computer for the player (Step S310). A grid may be generated according to a grid generation process, an example of which is discussed below with reference to FIG. 5 (Step S320). The generated grid may be reproduced on a game ticket as an add-on feature game or a feature game (Step S330).

In generating the grid with cells (Step S320), a completed grid may be randomly selected (or systematically selected, if so desired) from a predetermined set of completed grids using predefined rules. The predetermined set of grids may include all possible permutations of grids for a particular set of characters that have been generated and stored in a grid storage according to the predefined rules, such as, but not limited to, for example, a predetermined repetition frequency threshold for each character in a given grid, a predetermined number of single win grids, double win grids, etc., and the like.

Alternatively, a grid may be generated (Step S320) by, for example, populating each of the cells of the grid with one or more characters that have been provided by a player or one or more characters that have been provided by a computer device into n×m×o× . . . cells configured in a multidimensional grid (where n and m are positive integers greater than or equal to two, and o and subsequent dimensions are positive non-zero integers, all of which may have the same or different values). In the latter instance, the one or more characters may be generated using, for example, a random number generator; or the characters may be systematically selected from a larger group of characters.

The predefined rules may include, but are not limited to, for example, a number of occurrences of a particular character, a number of occurrences of a particular grid, a prize (or prizes) to be awarded to a single win grid, a double win grid, a triple win grid, a quadruple win grid, etc., a number of winners for a particular game of chance drawing, a number of winners for a particular geographic location, and the like. For example, the grid may be generated so that no character may be repeated more than x times on any single grid, where x is a positive integer greater than zero. Further, a particular grid may be generated so that no more than y occurrences (such as, e.g., eight occurrences) of the grid occur per z feature games (such as, e.g., one thousand games), where y and z are positive integers. A prize may be preset and associated with a particular winning grid. A preset number of winners may be provided for a particular feature game so that the number of winning grids may be controlled for the particular feature game. Moreover, the grid may be generated so that a particular winning grid is reproduced in a predetermined geographic location, which may be determined on a basis of, e.g., an area code, a zip code, geographic coordinates of longitude and latitude, a vendor address, a vendor identification, past winnings history at a particular vendor, the number of wins for a particular vendor, or the like. The skilled artisan will readily appreciate that other rules may be defined and applied without departing from the scope or spirit of the invention, depending on, for example, a particular application of the invention.

Where the winning characters are predetermined for a particular feature game, the predefined rules may be used to accurately and selectively control, for example, but not limited to, a number of winning game tickets, a number of certain types of winning game tickets, a number of prizes and/or a value of a prize to be awarded to a particular winning game ticket, the locations where the winning tickets may be provided, and the like.

For example, in generating a three-by-three (3×3) grid for a particular game ticket using the predefined rules (e.g., Step S320 in FIG. 4), a populated grid may be randomly selected (or systematically selected) from a plurality of stored grids, or the grid may be populated with characters provided by a player or by a computer. Each of the cells in the selected grid may be compared to, for example, three winning characters for the feature game. Additionally, each of the eight configurations of the cells on the grid may be compared to the three winning characters. In this regard, each row of cells on the grid, each column of cells on the grid and each diagonal line of cells on the grid may be compared to the three winning characters.

As the skilled artisan will readily appreciate, a winning grid may be selected for a three-by-three grid that is populated by numbers having a value of 0 to 9 so that eight winning grids are provided for every one thousand feature games provided. As a result of the above process, an even and random distribution of winning grids may occur starting at about ten thousand grids.

According to a further aspect of the invention, a computer program may be provided in at least one computer readable medium that, when executed on a general purpose computer (such as, for example, the remote computer 250 or local terminal 210 shown in FIG. 3) causes the computer to execute the steps S310 to S330 of the game ticket generation process. In this regard, the computer program may include a code section for executing each of the steps S310 to S330 (discussed above) on the general purpose computer to carry out the exemplary process shown in FIG. 4.

Figure 5:
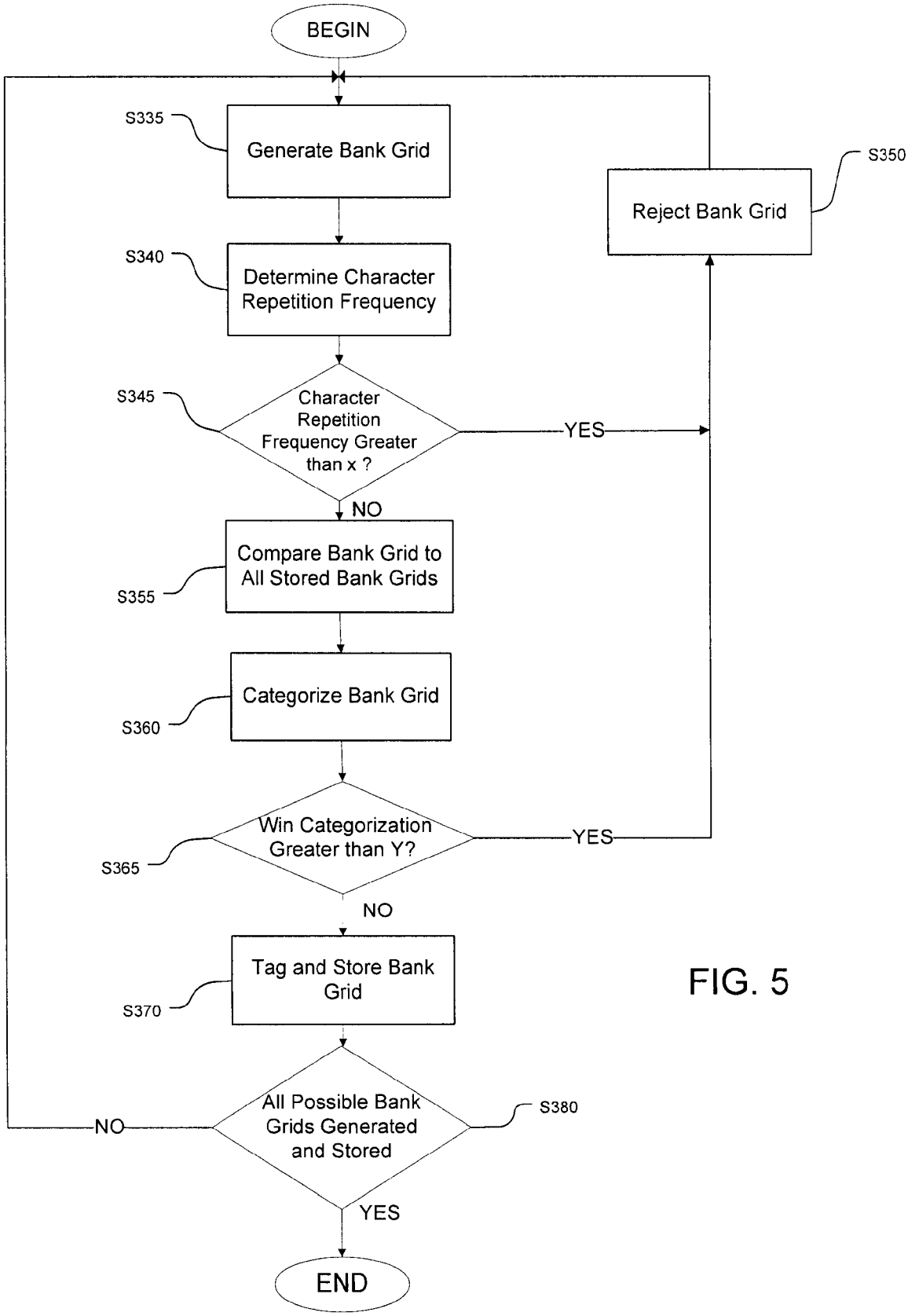
FIG. 5 shows an exemplary grid generation process according to an aspect of the invention.

FIG. 5 illustrates an exemplary grid generation process that may be executed for each feature game drawing or executed once for a predetermined number of feature game drawings. The exemplary grid generation process generates a bank grid having n×m cells configured in a multidimensional grid, where n and m are positive integers greater than or equal to two, which may have the same or different values (Step S335). The bank grid may be generated by, for example, populating each of the n×m cells of the bank grid with a character, which may be randomly or systematically selected from a set of available characters.

Once all of the n×m cells of the bank grid are populated, a determination may be made regarding the frequency (rate) of repetition of each of the characters populating the bank grid (Step S340). The determined repetition frequency for each of the characters may then be compared to a repetition frequency parameter in the predefined rules, which may include a repetition frequency parameter of x, where x is a positive integer greater than zero (Step S345). If a determination is made that a repetition frequency for any character in the bank grid is greater than x ("Yes" at Step S345), then the bank grid may be rejected (Step S350). The grid generation process will then return to generate another bank grid (Step S335).

If, however, a determination is made that a repetition frequency for each of the characters populating the bank grid is less than, or equal to x ("No" at Step S345), then the bank grid is compared to all stored bank grids for the feature game (Step S355). In particular, each of the possible winning combinations on the bank grid (such as, for example, the eight possible winning combinations in a 3×3 grid) may be compared to an equal number of possible winning combinations in each of the stored bank grids. For example, each of the rows of cells, the columns of cells and the diagonal lines of cells in the bank grid may be compared to the rows of cells, the columns of cells and the diagonal lines of cells in each of the stored bank grids.

Once the comparison of the bank grid to all of the stored bank grids is complete, the bank grid is categorized as a single win grid, a double win grid, a triple win grid, a quadruple win grid, etc. (Step S360). A determination may be made whether the bank grid categorization complies with a predefined rule, such as, for example, a parameter y setting a number of permissible wins, such as, for example, single wins, double wins, triple wins, quadruple wins, or the like, for the feature game, where y is a non-zero integer (Step S365). If a determination is made that the bank grid categorization exceeds the predefined rule (e.g., the bank grid characterization is greater than y) ("Yes" at Step 365), then the bank grid is rejected (Step S350).

However, if a determination is made that the bank grid categorization does not exceed the predefined rule ("No" at Step 365), then the bank grid is tagged and stored (Step S370). In this regard, the bank grid may be tagged by, for example, entering a grid-type identification in a field of a record associated with the bank grid, identifying the bank grid as, for example, a single win bank grid, a double win bank grid, a triple win bank grid, etc. Similarly, a grid-type identification may be entered or updated in a record associated with the stored bank grid(s) that were determined to match the winning combinations of the generated bank grid.

Next, a determination is made whether all possible bank grids have been generated and stored for a feature game grid having n×m cells, in accordance with the predefined rules (Step S380). If a determination is made that all of the possible bank grids have not been generated and stored ("No" at Step S380), then a new bank grid is generated (Step S335), otherwise the process ends ("Yes" at Step S380).

According to a still further aspect of the invention, a computer program may be provided in at least one computer readable medium that, when executed on a general purpose computer, causes the computer to execute the steps S335 to S380 shown in FIG. 5. In this regard, the computer program may include a code section for each of the steps S335 to S380 (discussed above) to cause the general purpose computer to carry out the exemplary process shown in FIG. 5.

Figure 6:
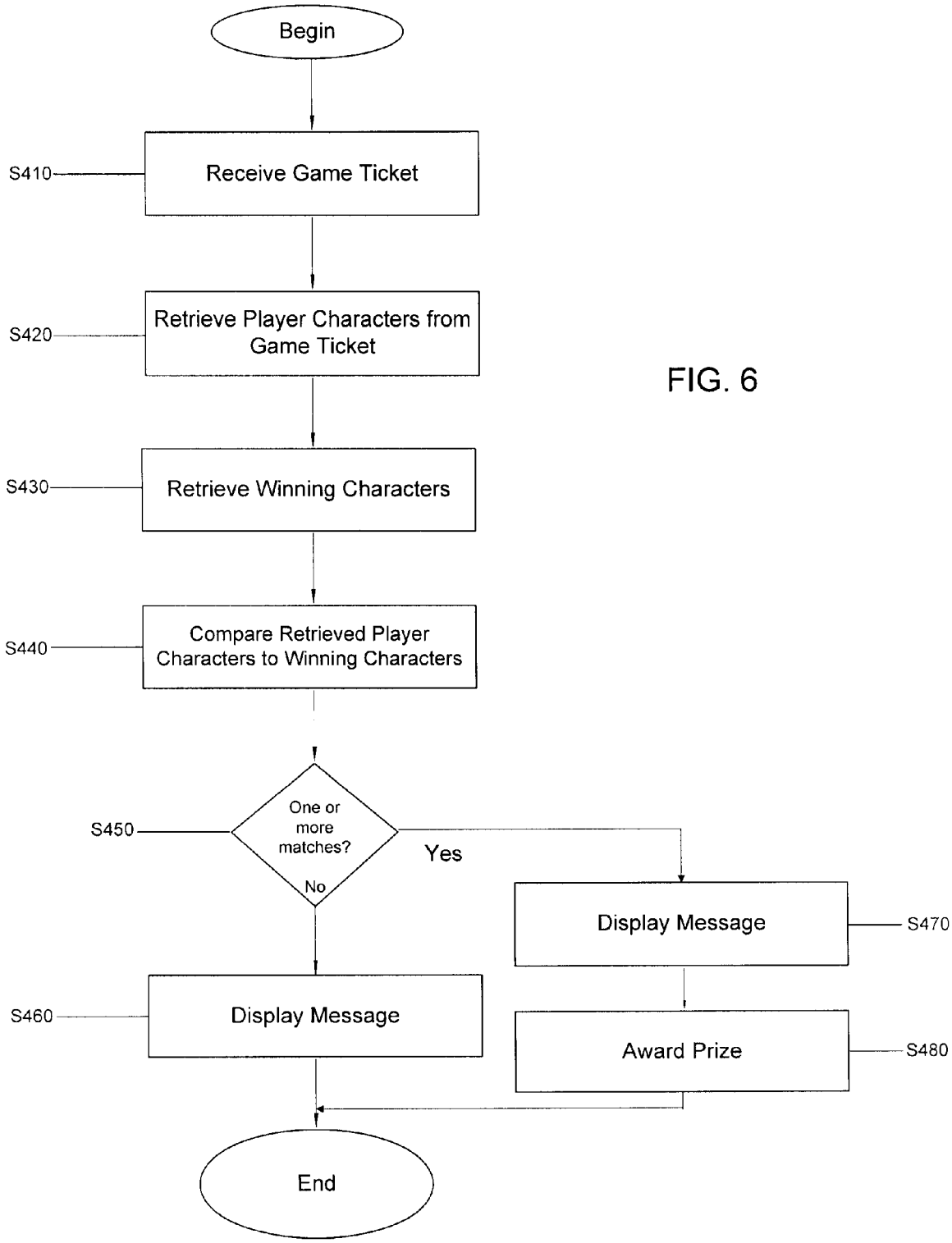
FIG. 6 shows an exemplary feature game redemption process according to an aspect of the invention.

FIG. 6 illustrates an exemplary feature game redemption process according to an aspect of the invention. The process may begin when a player submits a game ticket for redemption (Step S410). The game ticket may be submitted physically or electronically, as is known by those skilled in the art. After receiving the game ticket, all of the characters are retrieved from the grid on the game ticket or from a record associated with the particular game ticket, which may be stored in a local computer or in a remotely located computer and retrieved according to known record retrieval processes, as will be understood by those skilled in the art (Step S420).

After retrieving all of the characters from the game ticket (or associated with the game ticket), winning characters may be retrieved for the particular drawing(s) relevant to the game ticket (Step S430). The retrieved characters are compared to the retrieved winning characters for the relevant drawing(s) (Step S440). If one or more matches are determined to exist ("Yes" at Step S450), then a message is displayed, such as, for example, "WINNER" (Step S470), otherwise a message is displayed, such as, for example, "NO WINNER" (Step S460). In this regard, one or more matches may be determined to exist when the retrieved characters in one or more rows, columns or diagonals of cells in an n×m grid (where n and m are positive integers greater than or equal to two, which may have the same or different values) on the received game ticket are found to match the winning characters. After the message "WINNER" is displayed (Step S470), a prize is determined and awarded on a basis of the number of matches (Step S480). The prize may be determined on a basis of the number of matching rows, the number of matching columns, and/or the number of matching diagonal lines, with a more valuable prize being awarded with a greater number of matches, or types of matches. For example, matching characters in a diagonal line may be awarded a different prize from matching characters in a row or column. Further, the prize may be determined on a basis of, for example, the statistics of certain matches occurring in a feature game.

For example, in a feature game having a three-by-three grid with characters having a value between 0 and 9, there may exist a predetermined number of chances to win. Of these, a first subset may be single win chances, where the combination of winning characters appears only once on a grid. Further, a second subset may be double wins, where the combination of winning characters appears twice on a grid. Further, a third subset may be triple wins, where the combination of winning characters appears three times on the grid. Still further, a fourth subset may feature a quadruple win situation, where the combination of winning characters appears four times on a grid. Since more than, for example, but not limited to, ninety-five percent (95%) of winners may be single win game tickets, a first payout prize may be associated with a single win game ticket. Further, a second payout prize, a third payout prize and a fourth payout prize may be associated with a double win, a triple win and a quadruple win game ticket, respectively, where the payout prizes are different and increase in value and/or size with the number of wins. The double, triple or quadruple winner frequency can be increased by changing the parameter x in the predefined rule mentioned above to a higher number.

According to a still further aspect of the invention, a computer program may be provided in at least one computer readable medium that, when executed on a general purpose computer, causes the computer to execute the steps S410 to S480 shown in FIG. 6. In this regard, the computer program may include a code section for each of the steps S410 to S480 (discussed above) to cause the general purpose computer to carry out the exemplary process shown in FIG. 6.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed:

1. A system for executing a game of chance comprising a multidimensional grid that includes a plurality of characters, said system comprising:

a grid generator configured to generate a grid comprising a plurality of cells, each of the cells being populated by a character randomly selected from a set of characters;

a repetition frequency determiner configured to determine a repetition frequency for each character in the grid;

a repetition frequency comparator configured to compare the determined repetition frequency to a repetition frequency threshold;

a grid processor configured to process the grid on a basis of a result of the comparison of the determined repetition frequency to the repetition frequency threshold;

a winning combination determiner configured to determine all possible winning combinations of the plurality of cells in the grid;

a win combination comparator configured to compare said all possible winning combinations of the plurality of cells in the grid to each of the plurality of grids in to storage;

a win number determiner configured to determine a number of wins for the grid on a basis of a result of the win combination comparator; and a win number processor configured to process the grid on a basis of the determined number of wins.

2. The system of claim 1, wherein the win number processor comprises:

a win number comparator configured to compare the number of wins to a predetermined win number;

a tagger configured to tag the grid on a basis of a result of the win number comparator;

a retagger configured to retag at least one stored grid on the basis of the result of the win number comparator; the system further comprising:

a grid selector configured to select a grid from the plurality of stored grids; and a game ticket reproducer configured to reproduce the selected grid on a game ticket.

* * * * *